United States Patent [19]

Teramura et al.

[11] Patent Number: 4,460,518

[45] Date of Patent: Jul. 17, 1984

[54] DEVICE FOR CONTROLLING THE OPERATION OF A CARBURETOR

[75] Inventors: Mitsuyoshi Teramura; Masatami Takimoto, both of Toyota; Norihiko Nakamura, Mishima; Takaaki Itoh, Mishima; Takashi Katou, Mishima; Shunsuke Mizutani, Nukata; Yozo Sakakibara, Kariya, all of Japan

[73] Assignees: Toyota Jidosha Kabushiki Kaisha, Toyota; Aisan Industry Co., Ltd., Obu, both of Japan

[21] Appl. No.: 414,314

[22] Filed: Sep. 2, 1982

[30] Foreign Application Priority Data

Dec. 22, 1981 [JP] Japan ..... 56-206058

[51] Int. Cl.[3] ..... F02M 9/06

[52] U.S. Cl. ..... 261/39 A; 261/39 D; 261/52; 261/44 C; 261/121 B

[58] Field of Search ..... 261/44 C, 121 B, 39 A, 261/52, 39 D

[56] References Cited

U.S. PATENT DOCUMENTS

| | | | |
|---|---|---|---|
| 3,249,345 | 5/1966 | Gast | 261/39 D |
| 3,493,217 | 2/1970 | Farley | 261/121 B |
| 3,575,389 | 4/1971 | Goto et al. | 261/39 A |
| 3,764,120 | 10/1973 | Imai | 261/44 C |
| 3,934,571 | 1/1976 | Mennesson | 261/39 D |
| 3,956,434 | 5/1976 | Dickensheets et al. | 261/44 C |
| 4,276,238 | 6/1981 | Yoshikawa et al. | 261/44 C |
| 4,351,782 | 9/1982 | Bellicardi et al. | 261/39 A |

FOREIGN PATENT DOCUMENTS

| | | | |
|---|---|---|---|
| 52-9727 | 1/1977 | Japan | 261/121 B |
| 52-34139 | 3/1977 | Japan | 261/121 B |
| 52-54839 | 5/1977 | Japan | 261/121 B |
| 80707 | 6/1934 | Sweden | 261/39 A |

*Primary Examiner*—Tim R. Miles

*Attorney, Agent, or Firm*—Finnegan, Henderson, Farabow, Garrett & Dunner

[57] ABSTRACT

A control device comprising a push rod and a wax valve actuating the push rod in response to the temperature of the cooling water of an engine. The push rod is connected to the throttle valve of the carburetor so that the degree of opening of the throttle valve becomes smaller as the temperature of the cooling water of the engine is increased. The amount of air fed into the fuel passage from the air bleed passage is controlled by the push rod so that the amount of the air is increased as the temperature of the cooling water of the engine is increased. A vacuum-operated, time-delay valve is connected between the air-bleed passage and the atmosphere and increases the amount of air fed into the fuel passage from the air-bleed passage following a brief time delay period after the engine starts.

11 Claims, 5 Drawing Figures

DEVICE FOR CONTROLLING THE OPERATION OF A CARBURETOR

BACKGROUND OF THE INVENTION

The present invention relates to a device for controlling the operation of a carburetor.

In one known carburetor, a push rod is driven by a temperature reactive device, for example, a wax valve, which is actuated in response to engine temperature. The push rod is connected to a lever fixed onto the throttle shaft so that the degree of opening of the throttle valve is reduced as the engine temperature is increased after the engine is started. In another known carburetor, during engine warm-up, the amount of air bled into the fuel passage connected to the nozzle of the carburetor, that is, the amount of bled air, is controlled for the optimum air-fuel ratio. Despite the close relationship between the degree of opening of the throttle valve and the amount of bled air in ensuring stable engine operation during engine warm-up, however, the degree of opening of the throttle valve and the amount of bled air have been controlled independently in conventional carburetors. As a result, problems occur in that stable engine operation cannot be obtained during engine warm-up and the device for controlling the degree of opening of the throttle valve and the amount of bled air becomes complex.

SUMMARY OF THE INVENTION

An object of the present invention is to provide a device for controlling the operation of a carburetor, which enables stable engine operation during engine warm-up and can simultaneously control the degree of opening of the throttle valve and the amount of bled air, thereby simplifying the control system.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

According to the present invention, there is provided a device for controlling the operation of a carburetor for an internal combustion engine having an intake passage, a throttle valve arranged in the intake passage, a float chamber, a fuel passage connecting the float chamber to the intake passage, and an air bleed passage connected to the fuel passage, said device comprising: a housing having a bore therein; a push rod slidably inserted into said bore and operatively connected to the throttle valve, said push rod defining an atmospheric pressure chamber which is located within said bore and is open to the atmosphere; a port formed in said housing for connecting said atmospheric pressure chamber to the air bleed passage, said push rod cooperating with said port for controlling the area of opening of said port; a temperature reactive apparatus, connected to said push rod and actuating said push rod in response to engine temperature, for simultaneously controlling the degree of opening of the throttle valve and the amount of air fed into the fuel passage from the air bleed passage, and a vacuum operated valve controlling the fluid connection between the air bleed passage and the atmosphere for increasing the amount of air fed into the fuel passage from the air bleed passage following a time delay period after the engine starts.

The present invention may be more fully understood from the description of a preferred embodiment of the invention set forth below, together with the accompanying drawings.

DESCRIPTION OF A PREFERRED EMBODIMENT

Figure 1:
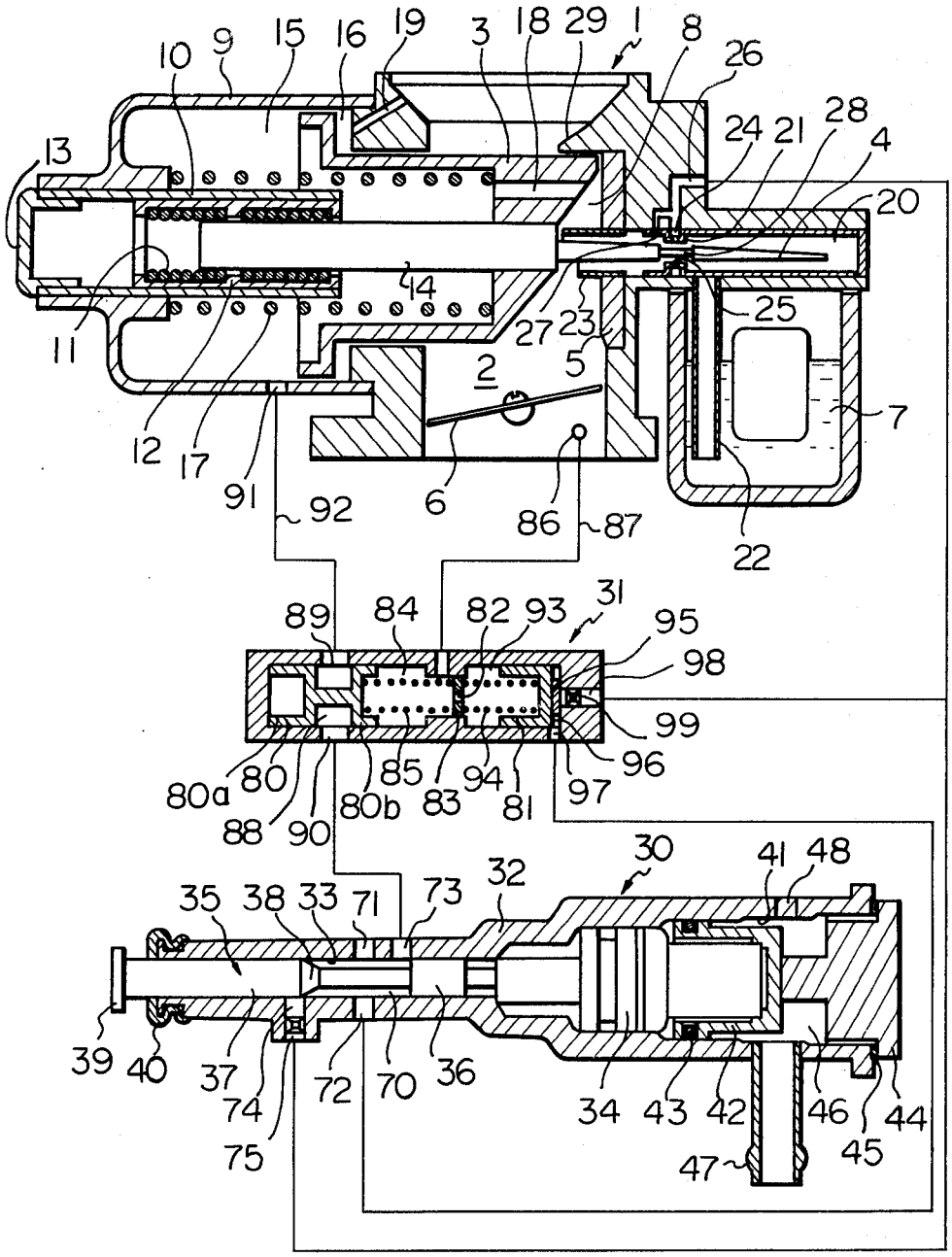
FIG. 1 is a cross-sectional side view of a carburetor and a control device according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3.

Numeral 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1. A guide sleeve 10, extending within the casing 9 in the axial direction thereof is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in its axial direction. Since the suction piston 3 is supported by the casing 9 via the bearing 12 as mentioned above, the suction piston 3 is able to smoothly move in the axial direction thereof.

The interior of the casing 9 is divided into a vacuum chamber 15 and an atmospheric pressure chamber 16 by the suction piston 3. A compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22. Fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects past the lower half of the tip portion of the nozzle 23 toward the suction piston 3. The needle 4 extends through the interior of the nozzle 23 and the metering jet 21. Fuel is fed into the intake passage 2 from the nozzle 23 after it is metered by an annular gap formed between the needle 4 and the metering jet 21.

As illustrated in FIG. 1, an annular air passage 24 is formed around the metering jet 21. A plurality of air bleed bores 25 interconnecting the annular air passage 24 to the interior of the metering jet 21 is formed in the inner peripheral wall of the metering jet 21. The annular air passage 24 is connected to an air bleed passage 26 formed in the carburetor body 1. In addition, an auxiliary air bleed bore 27 is formed on the upper wall of the fuel passage 20 located downstream of the metering jet 21. The auxiliary air bleed bore 27 is connected to the air bleed passage 26. The needle 4 has a reduced diameter portion 28 at the central portion thereof. The reduced diameter portion 28 is positioned in alignment with the metering jet 21 when the suction piston 3 closes the intake passage 2 to its maximum extent, as illustrated in FIG. 1.

A raised wall 29, projecting horizontally into the intake passage 2, is formed at the upper end of the spacer 5. Flow control is effected between the raised wall 29 and the tip end portion of the suction piston 3. When the engine is started, air flows downward within the intake passage 2. At this time, since the air flow is restricted between the suction piston 3 and the raised portion 29, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17. Accordingly, level of the vacuum created in the venturi portion 8 remains approximately constant.

As further illustrated in FIG. 1, the air bleed passage 26 is connected to a throttle control valve 30 and a vacuum control valve 31. The throttle control valve 30 comprises a circular bore 33 extending in the longitudinal direction within housing 32, and a wax valve 34. A push rod 35, driven by the wax valve 34, is slidably inserted into the circular bore 33. The push rod 35 has a pair of spaced enlarged portions 36 and 37. The enlarged portion 37 has a frustum-shaped inner end 38. The outer end of the enlarged portion 37 projects outwardly from the housing 32. A disc-shaped head 39 is formed in one piece on the tip of the enlarged portion 37. In addition, the projecting outer end of the enlarged portion 37 is surrounded by a seal member 40 mounted on the housing 32.

On the other end, the housing 32 has an increased diameter bore 41 formed therein. A wax valve holder 42 is fitted into the increased diameter bore 41. An O ring 43 is inserted between the wax valve holder 42 and the inner wall of the increased diameter bore 41. A plug 44 is screwed into the increased diameter portion 41 and fixed onto the housing 32 via a gasket 45 and, thus, the wax valve 34 is fixed in the housing 32 by means of the plug 44 via the wax valve holder 42. A cooling water chamber 46 is formed between the wax valve holder 42 and the plug 44, and a cooling water feed pipe 47 is connected to the cooling water chamber 46. Cooling water of the engine, fed into the cooling water chamber 46 via the cooling water feed pipe 47, is discharged from a cooling water discharge hole 48 after the cooling water heats the wax valve 34.

Figure 2:
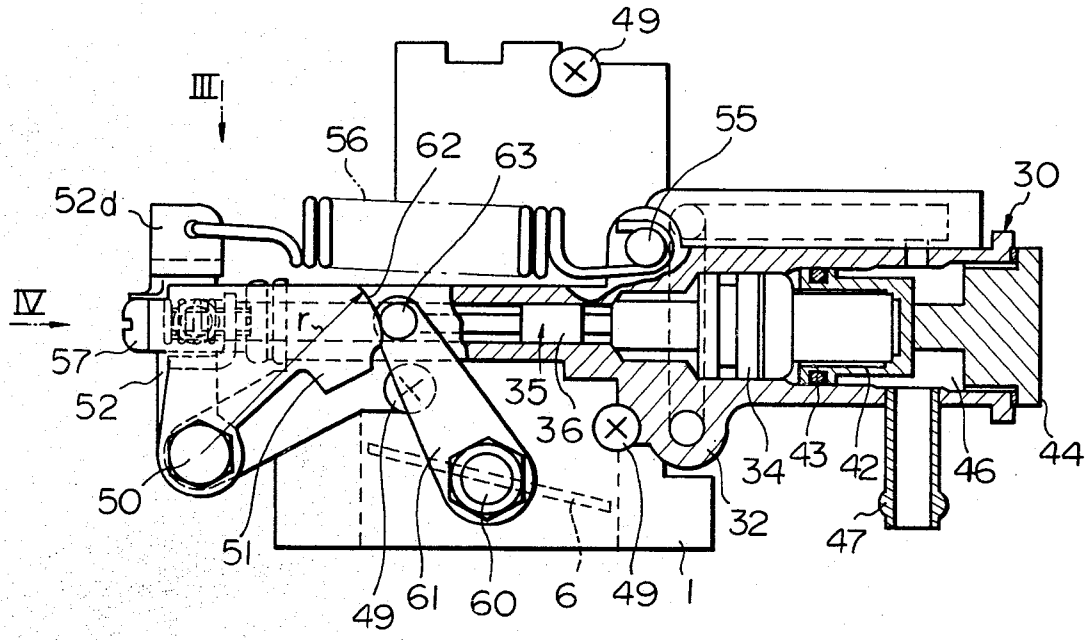
FIG. 2 is a side view, partly in cross-section, of a throttle control valve.
Figure 3:
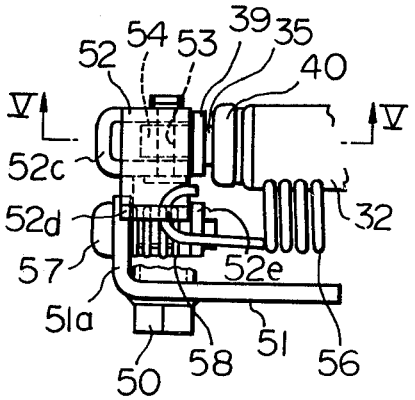
FIG. 3 is a plan view taken along the arrow III in FIG. 2.
Figure 4:
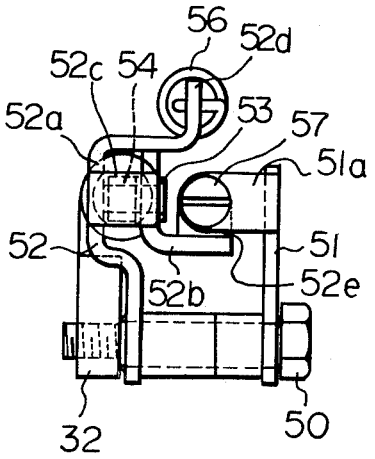
FIG. 4 is a side view taken along the arrow IV in FIG. 2.
Figure 5:
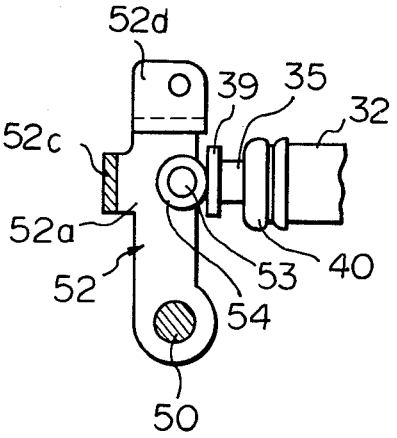
FIG. 5 is a cross-sectional view taken along the line V—V in FIG. 3.

As illustrated in FIG. 2, the housing 32 of the throttle control valve 30 is fixed onto the carburetor body 1 by means of three bolts 49. Referring to FIGS. 2 through 5, a bolt 50, functioning as a pivot, is secured onto the housing 32. A cam 51 and a lever 52 are rotatably mounted on the bolt 50. The lever 52 comprises an L-shaped member **52*b* spaced from an intermediate portion 52*a* of the lever 52. The intermediate portion 52*a* and the L-shaped member 52*b* are interconnected with each other by means of a U-shaped member 52*c*. A pin 53, extending through the intermediate portion 52*a* and the L-shaped member 52*b*, is fixed onto them, and a roller 54 is rotatably mounted on the pin 53. A tension spring 56 is arranged between a tip 52*d* of the lever 52 and a pin 55 fixed onto the housing 32 so that the roller 54 is continuously pressed in contact with the disc-shaped head 39 of the push rod 35 due to the spring force of the tension spring 56**.

An arm **52*e* is formed in one piece on the tip of the L-shaped member 52*b* of the lever 52. In addition, an arm 51*a*, facing the arm 52*e*, is formed in one piece on the end portion of the cam 51. An adjusting screw 57 is inserted into a bore (not shown) formed in the arm 51*a* of the cam 51, and the tip of the adjusting screw 57 is screwed into the arm 52*e* of the lever 52. Consequently, it is possible to adjust the relative position between the lever 52 and the cam 51 by rotating the adjusting screw 57. A compression spring 58, which serves to prevent the adjusting screw 57 from being loosened, is inserted between the arms 51*a* and 52*e*. The rotating force of the lever 52 is transferred to the cam 51 via the adjusting screw 37. When the lever 52 is rotated in the clockwise direction in FIG. 2, the cam 51** is accordingly rotated in the clockwise direction.

As illustrated in FIG. 2, a lever 61 is fixed onto a valve shaft 60 of the throttle valve 6, and a pin 63, which is engageable with a cam face 62 of the cam 51, is fixed onto the tip of the lever 61. As will be understood from FIG. 2, the radius r of the cam face 62, which is measured from the bolt 50, is gradually reduced toward the clockwise direction.

FIG. 2 illustrates the case where the engine temperature is low. At this time, the throttle valve 6 remains open by means of the cam 51. When the engine is started and the temperature of the cooling water of the engine is increased, the push rod 35 moves toward the left in FIG. 2 under the operation of the wax valve 34. As a result, since the lever 52 is rotated in the counterclockwise direction in FIG. 2, the cam 51 is also rotated in the counterclockwise direction and, thus, the throttle valve 6 is gradually closed. As mentioned above, since the roller 54 is provided between the lever 52 and the disc-shaped head 39 of the push rod 35, the lever 52 is smoothly rotated when the push rod 35 moves toward the left in FIG. 2.

Turning to FIG. 1, an atmospheric pressure chamber 70 is formed between the enlarged portions 35 and 36 within the circular bore 33 of the throttle control valve 30. The atmospheric pressure chamber 70 is always open to the atmosphere via an air hole 71. In addition, a first port 72, which is continuously open to the atmospheric pressure chamber 70, a second port 73, and a third port 74 are formed in the housing 32. A jet 75 is inserted into the third port 74. The fluid connection between the second port 73 and the atmospheric pressure chamber 70 is controlled by the enlarged portion 36. The fluid connection between the third port 74 and the atmospheric pressure chamber 70 is controlled by the enlarged portion 35.

A pair of pistons 80, 81 is slidably inserted into the interior of the vacuum control valve 31. A partition 83 having a restricted opening 82 is arranged between the pistons 80 and 81. A first vacuum chamber 84 is formed between the piston 80 and the partition 83. In addition, a compression spring 85 is inserted between the piston 80 and the partition 83. The first vacuum chamber 84 is connected via a vacuum conduit 87 to a vaccum port 86 which is open to the intake passage 2 located downstream of the throttle valve 6. The piston 80 comprises a pair of spaced piston members **80*a*, 80*b*. A pair of ports 89, 90 is open to an interior chamber 88 formed between the piston members 80*a* and 80*b*. The port 89 is connected via a conduit 92 to a port 91 which is open to the vacuum chamber 15. The port 90 is connected to the second port 73 of the throttle control valve 30**.

On the other end of valve 31 a second vacuum chamber 93 is formed between the piston 81 and the partition 83, and a compression spring 94 is inserted between the piston 81 and the partition 83. In addition, a seal member 95 is fixed onto the top face of the piston 81. A port 97, which is continuously open to an interior chamber 96 formed between the top face of the piston 81 and the inner wall of the housing of the vacuum control valve 31, is formed in the housing of the vacuum control valve 31 and connected to the first port 72 of the throttle control valve 30. A port 98, which is covered and uncovered by the seal member 95 of the piston 81, is formed in the housing of the vacuum control valve 31, and a jet 99 is inserted into the port 98. This port 98 and the third port 74 of the throttle control valve 30 are connected to the air bleed passage 26.

FIG. 1 illustrates the case wherein the engine temperature is low and wherein the engine is stopped. At this time, the suction piston 3 is located at a position wherein it closes the intake passage 2 to the maximum extent. When the starter motor (not shown) is rotated for starting the engine, since the level of vacuum which is produced in the intake passage 2 located downstream of the throttle valve 6 is small, the pistons 80, 81 of the vacuum control valve 31 are located at a position illustrated in FIG. 1. Consequently, at this time, since the vacuum chamber 15 is open to the atmosphere via the vacuum control valve 31 and the throttle control valve 30, the pressure in the vacuum chamber 15 is equal to the atmospheric pressure. Therefore, the suction piston 3 remains stopped at a position illustrated in FIG. 1.

At this time, since the reduced diameter portion 28 of the needle 4 is located opposite to the metering jet 21, the cross-sectional area of the annular gap formed between the needle 4 and the metering jet 21 is large and, thus, a large amount of fuel is fed into the intake passage 2 from the nozzle 23. At this time, since the port 98 of the vacuum control valve 31 is closed by the seal member 95 of the piston 81 and the third port 74 of the throttle control valve 30 is slightly opened, an extremely small amount of air is fed into the fuel passage 20 from the air bleed bores 25, 27. Consequently, when the engine is rotated by the starter motor, an extremely rich air-fuel mixture is fed into the cylinder of the engine.

Once the engine begins to rotate by its own power, since the level of vacuum which is produced in the intake passage 2 located downstream of the throttle valve 6 becomes great, the piston 80 of the vacuum control valve 31 instantaneously moves toward the right in FIG. 1 against the compression spring 85. As a result, the ports 89, 90 are closed by the piston member **80*a* of the piston 80. Therefore, since vacuum in the venturi portion 8 acts on the vacuum chamber 15 via the suction hole 18, the suction piston 3 moves toward the left in FIG. 1. As a result of this, since the reduced diameter portion 28 of the needle 4 comes out from the metering jet 21, the cross-sectional area of the annular gap formed between the needle 4 and the metering jet 21 is reduced. Thus, the amount of fuel fed from the nozzle 23** is reduced.

Even if the level of vacuum in the intake passage 2 located downstream of the throttle valve 6 becomes great, since the restricted opening 82 is present between the first vacuum chamber 84 and the second vacuum chamber 93, the level of vacuum in the second vacuum chamber 93 does not instantaneously become great. Consequently, the port 98 remains closed by the seal member 95 of the piston 81 for a brief time delay period. Since the level of vacuum in the second vacuum chamber 93 becomes great soon after the engine begins to rotate by its own power, i.e., once this brief time delay ends, the piston 81 gradually moves toward the left in FIG. 1 against the compression spring 94. Thus, the port 98 gradually opens. As a result of this, the amount of air fed into the fuel passage 20 from the air bleed bores 25, 27 is increased, and the air-fuel mixture fed into the cylinder of the engine gradually becomes lean.

After this, since the push rod 35 moves toward the left in FIG. 1 as the temperature of cooling water of the engine is increased, the opening area of the third port 74 is gradually increased. As a result of this, since the amount of air fed into the fuel passage 20 from the air bleed bores 25, 27 is gradually increased, the air-fuel mixture fed into the cylinder of the engine gradually becomes lean. After this, when the engine warm-up is completed, the third port 74 fully opens, and the air-fuel mixture having a predetermined air-fuel ratio is fed into the cylinder of the engine.

When the engine warm-up is completed, the second port 73 is closed by the enlarged portion 36 of the push rod 35. Consequently, even if the engine is started when the engine temperature is high, the vacuum in the venturi portion 8 acts on the vacuum chamber 15, and the reduced diameter portion 28 of the needle 4 instantaneously comes out from the metering jet 21. In addition, at this time, since a large amount of air is fed into the fuel passage 20 from the air bleed bores 25, 27, there is no danger that the air-fuel mixture fed into the cylinder of the engine will become excessively rich.

According to the present invention, during engine warm-up, since the degree of opening of the throttle valve 6 and the amount of air bled from the air bleed bores 25, 27 are simultaneously controlled by the wax valve 34 so that the air-fuel ratio of mixture fed into the cylinder of the engine is controlled in response to the degree of opening of the throttle valve, stable engine operation can be obtained. In addition, since the disc-shaped head 39 of the push rod 35, driven by the wax valve 34, is connected to the lever 52, it is possible to smoothly rotate the cam 51.

While the invention has been described with reference to a specific embodiment chosen for purposes of illustration, it should be apparent that numerous modifications could be made thereto by those skilled in the art without departing from the basic concept and scope of the invention.

We claim:

1. A device for controlling the operation of a carburetor for an internal combustion engine having an intake passage, a throttle valve arranged in the intake passage, a float chamber, a fuel passage connecting the float chamber to the intake passage, and an air bleed passage connected to the fuel passage, said device comprising:

a housing having a bore therein;

a push rod slidably inserted into said bore and operatively connected to the throttle valve, said push rod defining an atmospheric pressure chamber which is located within said bore and is open to the atmosphere;

a port formed in said housing for connecting said atmospheric presure chamber to the air bleed passage, said push rod cooperating with said port for controlling the area of opening of said port;

a temperature reactive apparatus connected to said push rod and actuating said push rod in response to engine temperature for simultaneously controlling the degree of opening of the throttle valve and the amount of air fed into the fuel passage from the air bleed passage; and a vacuum operated valve controlling the fluid connection between the air bleed passage and the atmosphere for increasing the amount of air fed into the fuel passage from the air bleed passage following a time delay period after the engine starts.

2. A device according to claim 1, wherein said temperature reactive apparatus comprises a wax valve arranged in said housing.

3. A device according to claim 2, wherein said housing has a cooling water chamber formed therein adjacent to said wax valve for actuating said wax valve in response to the temperature of the cooling water of the engine.

4. A device according to claim 1, wherein said device comprises a link mechanism interconnecting said push rod to the throttle valve for reducing the degree of opening of the throttle valve in accordance with an increase in the engine temperature.

5. A device according to claim 4, wherein said link mechanism comprises a pivot, a lever rotatably mounted on said pivot and connected to said push rod, a cam rotatably mounted on said pivot and connected to said lever, and an arm fixed onto the throttle valve and being engageable with said cam.

6. A device according to claim 5, wherein said lever has a roller rotatably mounted thereon in connecting engagement with said push rod.

7. A device according to claim 5, wherein said link mechanism further comprises an adjusting screw interconnecting said lever and said cam for adjusting the relative position between said lever and said cam.

8. A device according to claim 5, wherein said cam has a cam face having a radius which is continuously changed along a rotating direction of said cam, said arm engaging with said cam face.

9. A device according to claim 1, wherein said push rod comprises a pair of enlarged portions defining said atmospheric pressure chamber therebetween, one of said enlarged portions having a frustrum-shaped end which cooperates with said port for controlling said area of opening and thereby increasing the amount of air fed into the fuel passage from the air bleed passage in accordance with an increase in the engine temperature.

10. A device according to claim 1 wherein said vacuum operated valve comprises a valve housing, a bore formed in said valve housing, a spring-loaded piston slidably inserted into said bore and dividing the interior of said bore into a vacuum chamber and a second atmospheric pressure chamber, a second port connected to the air bleed passage and normally closed by said piston, and a restricted opening positioned between said vacuum chamber and the intake passage downstream of the throttle valve for determining said time delay period, said vacuum operated valve connecting said second port to said second atmospheric pressure chamber following said time delay period.

11. A device according to claim 10, wherein said second atmospheric pressure chamber is connected to said atmospheric pressure chamber in said bore.

* * * * *